US008393387B2

(12) United States Patent
Harmon et al.

(10) Patent No.: US 8,393,387 B2
(45) Date of Patent: Mar. 12, 2013

(54) ANCHORING SYSTEM AND METHOD

(75) Inventors: Stephen K. Harmon, Cypress, TX (US); Christopher W. Guidry, Spring, TX (US); Marcelle H. Hedrick, Kingwood, TX (US); Brett W. Hrabovsky, Houston, TX (US); Guruswami Navin, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 377 days.

(21) Appl. No.: 12/722,207

(22) Filed: Mar. 11, 2010

(65) Prior Publication Data

US 2010/0230116 A1 Sep. 16, 2010

Related U.S. Application Data

(60) Provisional application No. 61/159,663, filed on Mar. 12, 2009.

(51) Int. Cl.
*E21B 23/00* (2006.01)

(52) U.S. Cl. ..... 166/118; 166/206; 166/382

(58) Field of Classification Search ..... 166/118, 166/120, 195, 206, 216, 382
See application file for complete search history.

(56) References Cited

U.S. PATENT DOCUMENTS

| | | | | |
|---|---|---|---|---|
| 3,991,826 | A | 11/1976 | Baugh | |
| 4,059,150 | A | 11/1977 | Manderscheid | |
| 4,359,090 | A | 11/1982 | Luke | |
| 4,754,814 | A * | 7/1988 | Jordan, Jr. | 166/387 |
| 5,350,013 | A | 9/1994 | Jani et al. | |
| 6,123,148 | A * | 9/2000 | Oneal | 166/118 |
| 2002/0066577 | A1 * | 6/2002 | Dewey et al. | 166/382 |
| 2002/0121380 | A1 * | 9/2002 | Doane et al. | 166/382 |
| 2005/0230108 | A1 * | 10/2005 | Mackenzie et al. | 166/250.01 |

FOREIGN PATENT DOCUMENTS

EP 1201875 A2 5/2002

OTHER PUBLICATIONS

Notification of Transmittal of the International Search Report and the Written Opinion of the International Searching Authority, or the Declaration; PCT/US2010/026998; Korean Intellectual Property Office, Mailed Sep. 27, 2010.

Brown, W.H. et al. "Drilling, Completion, Isolation and Thru Tubing Re-entry of Multilaterals in Hard Open Hole Formations," [Abstract Only], Offshore Technology Conference, Apr. 30-May 3, 2001, Houston, Texas.

Dreesen, Donald S. et al, "Openhold Packer for High-Temperature Service ina 500 degrees F Precambrian Wellbore," [Abstract Only] SPE Production Engineering, vol. 3, No. 3, Aug. 1988, pp. 351-360.

"Hanger Packers," [online]; [retrieved May 20, 2010]; retrieved from the Internet: http://www.bakerhughes.com/products-and-services/completions-and-productions/well-completions/liner-systems-wellbore-isolation/hanger-packers.

Pettitt, Roland A. et al. "Sidetracking Experiences in Hot Granitic Wellbores," Conference: Geothermal Resources Council annual meeting, Houston, TX, USA, Oct. 25, 1981.

* cited by examiner

*Primary Examiner* — David Andrews
*Assistant Examiner* — Taras P Bemko
(74) *Attorney, Agent, or Firm* — Cantor Colburn LLP

(57) ABSTRACT

An anchor system includes an anchoring device. The anchoring device is operably connected to at least one of a restriction indicator and a load isolation device each of which include a release member that releases at a selected load in order to ensure setting of the anchor at a desired location. A method is included.

18 Claims, 5 Drawing Sheets

ANCHORING SYSTEM AND METHOD

CROSS REFERENCE TO RELATED APPLICATIONS

This application claims the benefit of an earlier filing date from U.S. Provisional Application Ser. No. 61/159,663 filed Mar. 12, 2009, the entire disclosure of which is incorporated herein by reference.

BACKGROUND

In industries concerned with actions taken within earth formations, it is often necessary to anchor tools needed for a plethora of possible operations. Anchors come in many different forms and constructions and each has its strengths and weaknesses and hence each type tends to be favored for a relatively specific class of applications. While existing anchors work well for their intended purpose and are generally reliable, the costs of operational inconsistencies in downhole applications are significant. The art is therefore consistently seeking and interested in alternative constructions that improve reliability.

SUMMARY

An anchor system includes an anchoring device and at least one of a restriction indicator and a load isolation device in operable communication with the anchoring device.

A method for setting of an anchoring system includes protecting an outer gage diameter of an anchoring device with a restriction indicator having a gage diameter greater than any gage diameter of the anchoring device; and configuring the restriction indicator to hold a selected amount of string weight in the event that the system contacts a restriction in a borehole in which the system is being run.

BRIEF DESCRIPTION OF THE DRAWINGS

Referring now to the drawings wherein like elements are numbered alike in the several Figures.

DETAILED DESCRIPTION

Figure 1:
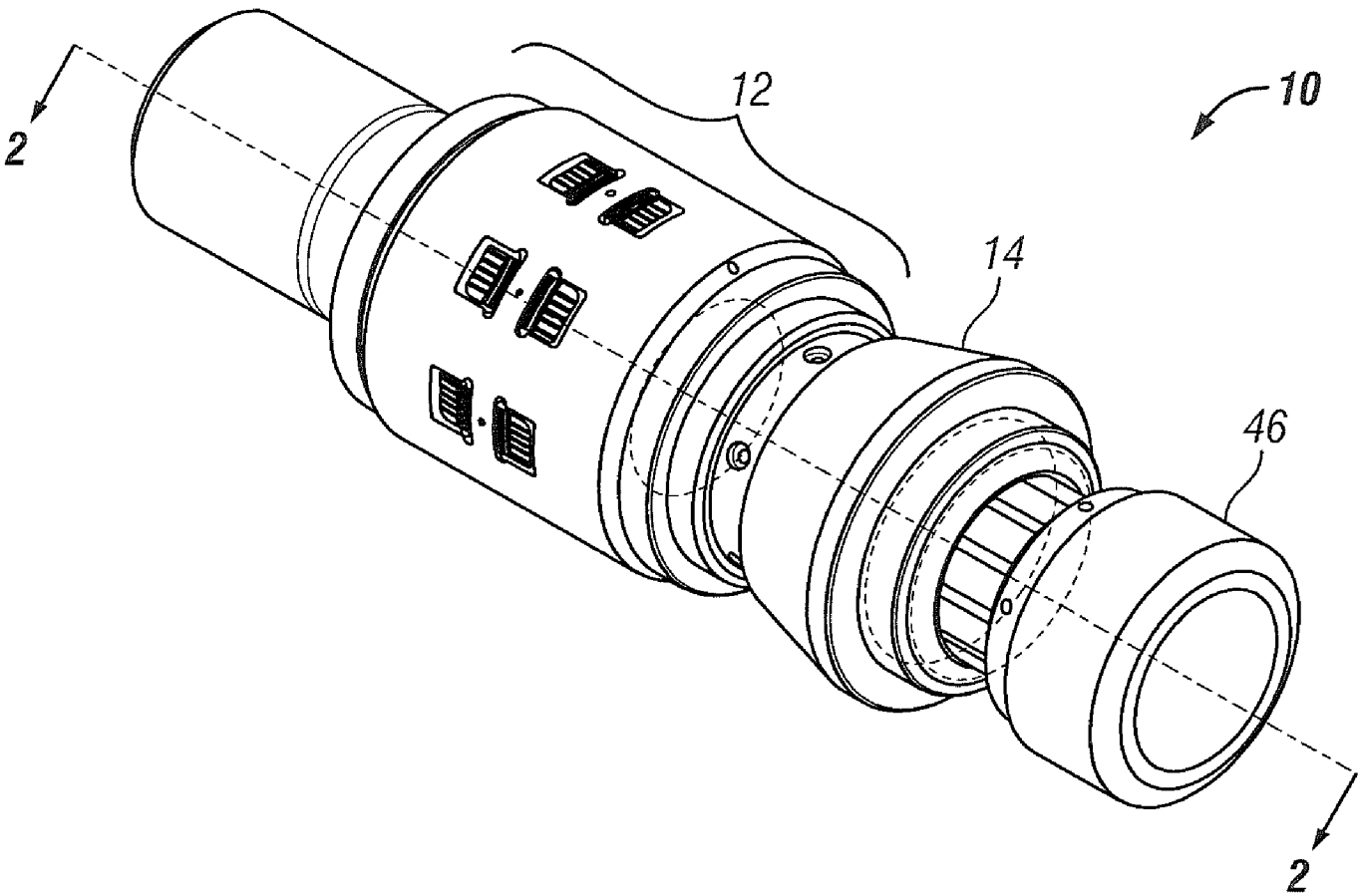
FIG. 1 is a perspective view of an anchor system.

Referring to FIG. 1, an anchor system 10 is illustrated in perspective view. A mid to uphole portion of the drawing, identified by bracket 12, depicts an anchoring device that is commercially available from Baker Hughes Incorporated under Product Family H15054. Downhole of this portion (to the right in the Figure) is a new configuration providing significantly improved function to the H15054 product. The new configuration may include either or both of a restriction indicator 14 and a load isolation device 46, which in one embodiment is a collet device and in other embodiments may be a spring, j-slot, shear ring, parting ring, body lock ring, burst disk or other release configuration capable of selectively permitting setting of the anchor. Each has a separate function and hence can be used independently with the related benefit to an anchor system using the same. Together, additional benefit is achieved. An embodiment that includes both the restriction indicator 14 and the load isolation device 46 is specifically illustrated. It is to be understood that either of these features could be deleted from the drawing such that the drawing illustrates the other configuration alone.

Figure 2:
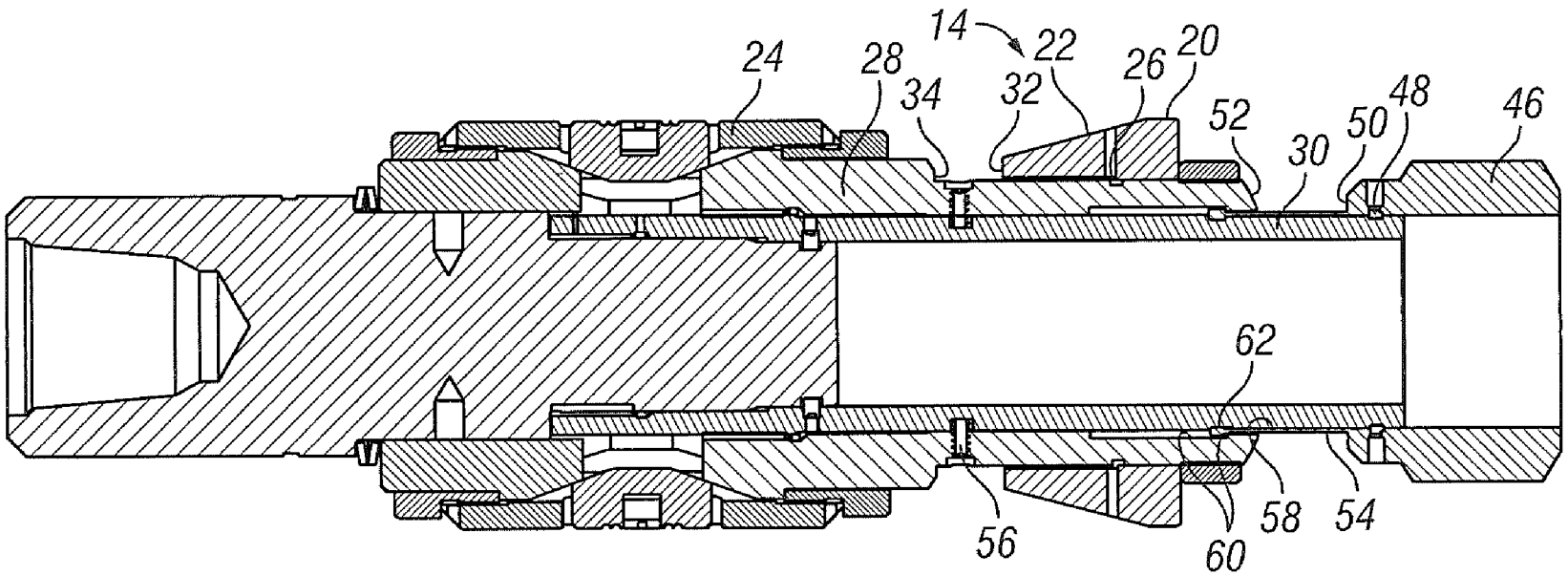
FIG. 2 is a cross section view of the anchor illustrated in FIG. 1 taken along section line 2-2.

Referring to FIG. 2, the restriction indicator 14 is to be configured to have a gage surface 20 that is of greater dimension than any other portion of the system 10. It is to be appreciated that the surface 20 is also axially relatively short and the restriction indicator 14 further includes a frustoconical section 22. These attributes of the restriction indicator 14 work together to ensure that the restriction indicator is the most likely component of the system 10 to experience contact at a restriction within the borehole in which the system 10 is run. The configuration also ensures that in the event that a contact occurs, it is relatively easy to dislodge the system because of the relatively narrow band of material at surface 20 that can be lodged. When the restriction indicator 14 is employed, a relatively small frictional interaction is usually all that needs to be overcome to release the system from a restriction. This is further discussed hereunder.

Restriction indicator 14 presents a relatively small gage surface 20 that is exposed to and might encounter a restriction contact. In addition, because of the short axial length of the surface 20 and the configuration of the frustocone 22, if a restriction is encountered, it is a relatively easy affair to pull the system 10 back uphole and out of the restriction. Further, the restriction indicator provides a warning signal to an operator in that the restriction indicator 14 is releasably affixed by a release member 26 to a lower cone 28 which itself is releasably affixed by a another release member 56 (shear screw(s), parting ring, body lock ring, collet, etc.) to a shear sleeve 30. In one embodiment, the release member 26 is a shear ring, but it will be understood that other release members, such as shear screw(s), parting ring, body lock ring, collet, etc., could be substituted. The release member 26 provides a signal to an operator indicative of a restriction by holding some selected amount of weight and then releasing causing a slack off in weight on the derrick (not shown) at surface and then a return of the weight, or in other words a spike (except in the negative direction with respect to load). The amplitude of the signal is dictated by the release value of the release member 26 and can be adjusted during manufacture of the system 10.

Referring now to the load isolation device 46, this feature provides the function of ensuring that the anchor system 10 sets only at a selected location such as the bottom of a borehole in which the anchor is to be used or at a landing profile (discussed hereunder as alternative embodiment) intended to cause the actuation. It ensures this by presenting a significantly lesser gage diameter than other components of the system 10. This helps in the function of the system 10 in that it predisposes the actuation of the system 10 at the selected location such as the bottom of the borehole or at a landing profile, as is intended. Because the collet is of significantly smaller gage diameter, the likelihood of being actuated by a restriction is consequently smaller. The collet 46 is releasably secured by a collet release member 48 (shear screw(s), parting ring, body lock ring, collet, etc) to the shear sleeve 30 to prevent actuations caused merely by drag of the collet 46 along borehole structures during running. It is to be appreciated that in one embodiment the collet 46 extends downhole (to the right in the drawing) of the shear sleeve 30 by enough distance to allow the collet actuation shoulder 50 to make contact with and actuate a lower cone actuation shoulder 52. Upon contact of the collet with the bottom of the hole (not shown), in the embodiment of FIGS. 1 and 2, load is built upon the collet release member 48 until a selected value of the release member is reached and surpassed. At that point the load isolation device 46 will move in an uphole direction relative to the rest of the system 10. In fact, the load isolation device 46 has simply stopped moving downhole while the rest of the system 10 continues moving downhole. The load isolation device 46 moves closer to the lower cone 28 until actuation shoulder 50 on the load isolation device 46 makes contact with the actuation shoulder 52 of the lower cone 28. In this position, the shear sleeve 30 is still extending for a lesser distance downhole than that of the load isolation device 46 thereby allowing the load isolation device 46 to provide a load to lower cone 28 and effectuate setting of the system 10.

Figure 3:
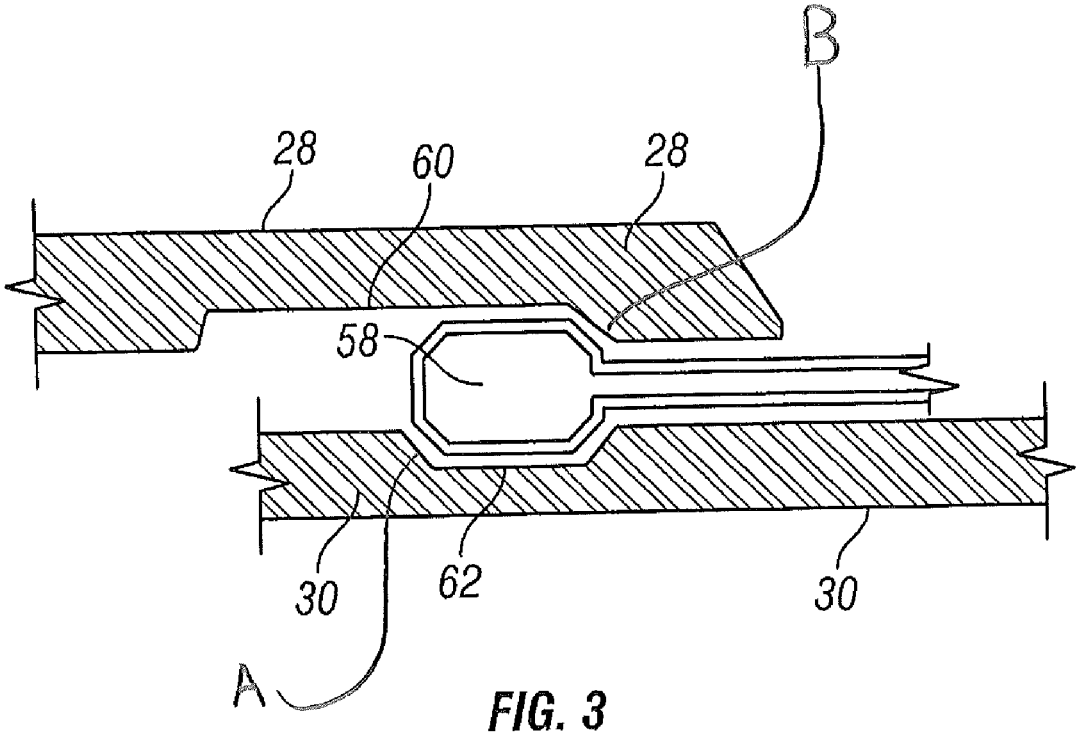
FIG. 3 is a schematic enlarged view of the area proximate the enlarged ends 58.

Collet fingers 54 function to help prevent unintended actuation through the restriction indicator 14, pursuant to a restriction, by transferring from the lower cone 28 to the shear sleeve 30 the load occasioned by contact between shoulder 32 and shoulder 34, which is otherwise resisted only by setting release member 56. The fingers 54 include enlarged ends 58 to interact with the shear sleeve 30 at groove 62 and lower cone 28 through undercut 60 therein, in which the ends 58 are positioned. In this configuration, unintended actuation due to the system encountering a restriction with restriction indicator 14 requires release of the release member 26, movement of the restriction indicator 14 to load shoulders 32 and 34. At this point, however, the load being transferred between load shoulders 32 and 34 will be transmitted axially along the lower cone, and will then load into the enlarged ends 58 of the collet fingers (through load shoulder B). The enlarged ends 58 of the collet fingers will then be placed into compression against load shoulder A. While this load is applied, the setting of the anchor 10 is prevented (see FIG. 3). Thus the probability of achieving the intended setting is enhanced.

Figure 4:
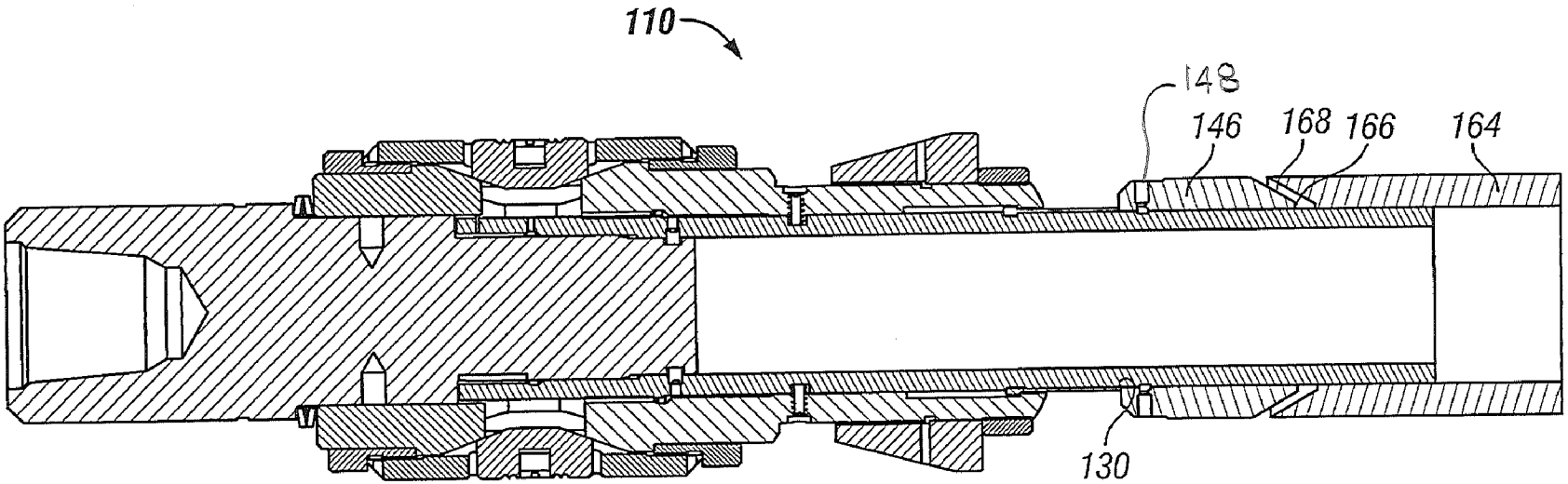
FIG. 4 is a representation similar to that of FIG. 2 with the system modified to set based upon landing at a preinstalled structure in a borehole.

In another embodiment, illustrated in FIG. 4, a system 110 is configured to actuate based upon landing in a preinstalled structure 164. Structure 164 may be for example a tubular of some kind that has been previously placed in the borehole and is in some way held in place, perhaps by an anchoring system of some kind. The structure is configured at an uphole end thereof to interact selectively with a load isolation device 146. This removes the requirement of the previously described embodiment that the load isolation device 46 extend downhole of the shear sleeve 30. In the illustrated embodiment of FIG. 4, the shear sleeve 130 extends downhole of the load isolation device 146 and thereby offers additional protection thereto with regard to unintentionally engaging the load isolation device 146, shearing the release member 148, and setting the system 110 while running downhole. The structure 164 is configured to receive the shear sleeve 130 thereby aligning the system 110 in the borehole. After the shear sleeve 130 is received in the structure 164, actuation end 166 will come into loaded contact with collet end 168 and cause actuation of the system 110 similarly to that described above for the embodiment of FIGS. 1-3. It will be understood that in one embodiment as shown, the ends 166 and 168 are profiled complementarily to one another. This profile may be angled as shown or orthogonal, or the surface may have another shape that aids in orientation of the system 110, for example.

Figure 5:
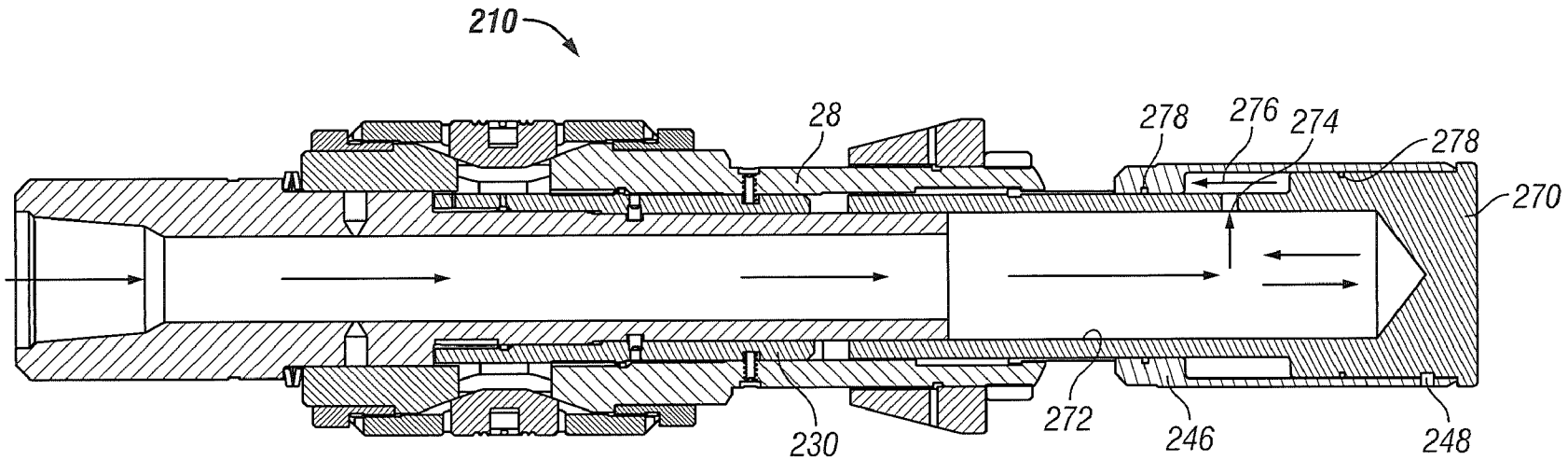
FIG. 5 is a schematic illustration of a hydraulic embodiment of the system disclosed herein.

Referring now to FIG. 5, another alternate embodiment of the system 210 is illustrated. In this embodiment the system 210 is actuated hydraulically and requires no set down weight on bottom or any structure. This embodiment may be located anywhere in the borehole that is desired. The system 210 includes a bottom sub 270 that replaces a portion of the shear sleeve 30 and 130 of the previous embodiments leaving the shear sleeve 230 as shown in FIG. 5. The bottom sub 270 includes a hydraulic pathway 272 therein that feeds a port 274. Hydraulic pressure is provided to this port 274 by string pressure that may be applied from the surface or other remote location. It is also possible for the system 210 to carry its own pressure source which may be in the form of a selectively openable chamber, a pump, etc. for example. Upon pressurization of the port 274, fluid pressure within a hydraulic chamber 276, defined in part by the collet 246 and in part by the sub 270, is contained therein by seals 278, which may be for example, o-rings. The increasing pressure in hydraulic chamber 276 ultimately will cause release of the release member 248 thereby facilitating movement of the collet 246 toward lower cone 28. This movement is analogous to the movement of the load isolation device 46 in the first described embodiment and causes similar consequent actions of the system 210.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. An anchor system comprising:

an anchoring device;

a lower cone arranged to effectuate setting of the anchoring device;

a shear sleeve disposed within the lower cone, the lower cone releasably affixed to the shear sleeve; and at least one of a restriction indicator having a greater overall radial dimension than any other component of the anchor system when the anchoring device is in an unset condition and including an indicator release member configured to secure the restriction indicator to an exterior of the lower cone, the indicator release member having a selected release load value, or a load isolation device having a smaller overall radial dimension than the anchoring device and restriction indicator and including an isolation release member configured to secure the isolation device to the shear sleeve to axially space an actuation shoulder of the load isolation device from the lower cone, the isolation release member having a selected release load value, the restriction indicator and/or the isolation device being in operable communication with the anchoring device.

2. An anchoring system as claimed in claim 1 wherein the system includes both of the restriction indicator and the load isolation device.

3. An anchoring system as claimed in claim 1 wherein the system includes the restriction indicator, and the restriction indicator presents a gage diameter larger than a largest gage diameter of the anchoring device in the unset condition.

4. An anchoring system as claimed in claim 3 wherein the restriction indicator includes a gage surface at the gage diameter of the restriction indicator that is short in axial length relative to an axial length of the restriction indicator.

5. An anchoring system as claimed in claim 1 wherein the system includes the restriction indicator, and the restriction indicator includes a frustoconical feature.

6. An anchoring system as claimed in claim 1 wherein the system includes the restriction indicator, and the indicator release member is a shear ring.

7. An anchoring system as claimed in claim 1 wherein the system includes the load isolation device, and the load isolation device includes a plurality of fingers.

8. An anchoring system as claimed in claim 7 wherein the plurality of fingers include enlarged ends in operable communication with the lower cone.

9. An anchoring system as claimed in claim 1 wherein the system includes the load isolation device, and the isolation release member is a shear screw.

10. An anchoring system as claimed in claim 1 wherein the system includes the load isolation device, and the load isolation device extends beyond a terminus of the shear sleeve to an extent to ensure that the load isolation device can stroke enough to set the anchoring device before the shear sleeve is in a position relative to the load isolation device to be coterminus therewith.

11. An anchoring system as claimed in claim 1 wherein the system includes the load isolation device, and the shear sleeve extends beyond a terminus of the load isolation device to an extent to ensure that the shear sleeve must engage a separate structure receptive thereto before the load isolation device is actuated.

12. An anchoring system as claimed in claim 11 wherein the separate structure is a tubular installed in a borehole prior to the system engaging the separate structure.

13. A method for setting of an anchoring system comprising:

protecting an outer gage diameter of an anchoring device with a restriction indicator having a gage diameter greater than any gage diameter of the anchoring device, in an unset condition of the anchoring device; and configuring the restriction indicator with a release member to hold a selected amount of string weight in the event that the system contacts a restriction in a borehole in which the system is being run prior to the release member releasing, the release member releasably securing the restriction indicator to an exterior of a lower cone of the anchoring device, the lower cone arranged to effectuate actuation of the anchoring device.

14. A method for setting of an anchoring system as claimed in claim 13 further comprising:

configuring the anchoring system to actuate only upon reaching a setting location by requiring a load isolation device to release and shift before actuation of the anchoring device can occur.

15. A method for setting an anchoring device of an anchor system comprising:

running the device as claimed in claim 1;

landing one of the restriction indicator at a restriction or the load isolation device at a setting location; and signaling the landing in a restriction or setting the anchoring device.

16. An anchoring system as claimed in claim 1 wherein the system further includes a hydraulic actuation configuration.

17. An anchoring system as claimed in claim 16 wherein the system includes the load isolation device, and the hydraulic actuation configuration includes a bottom sub having a hydraulic pathway in association therewith and a port in fluid communication with the pathway, the port being in fluid communication with a hydraulic chamber configured to cause movement of the load isolation device upon application of fluid pressure in the hydraulic chamber.

18. An anchoring system as claimed in claim 17 wherein the hydraulic pathway is fluidly connected to tubing pressure.

* * * * *